US006866687B2

(12) United States Patent
Batchelor

(10) Patent No.: US 6,866,687 B2
(45) Date of Patent: Mar. 15, 2005

(54) COMPOSITION AND METHOD FOR BLEACHING A SUBSTRATE

(75) Inventor: Stephen Norman Batchelor, Wirral (GB)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/671,286

(22) Filed: Sep. 25, 2003

(65) Prior Publication Data

US 2004/0060122 A1 Apr. 1, 2004

(30) Foreign Application Priority Data

Sep. 27, 2002 (GB) ..... 0222501

(51) Int. Cl.[7] ..... D06L 3/00
(52) U.S. Cl. ..... 8/107; 8/101; 8/648
(58) Field of Search ..... 8/101, 107, 648

(56) References Cited

U.S. PATENT DOCUMENTS

| | | | | |
|---|---|---|---|---|
| 3,749,672 A | * | 7/1973 | Golton et al. | 252/186.34 |
| 4,144,226 A | | 3/1979 | Crutchfield et al. | |
| 4,146,495 A | | 3/1979 | Crutchfield et al. | |
| 5,229,027 A | * | 7/1993 | Ahmed | 510/221 |
| 5,236,614 A | * | 8/1993 | Jacquet et al. | 510/214 |
| 5,746,936 A | * | 5/1998 | Mercado | 252/187.25 |
| 6,211,131 B1 | * | 4/2001 | Kaaret et al. | 510/318 |

FOREIGN PATENT DOCUMENTS

| | | | |
|---|---|---|---|
| EP | 0 070 074 | | 7/1982 |
| EP | 0 311 175 | | 9/1988 |
| EP | 0 328 177 B1 | | 1/1989 |
| EP | 0 346 995 B1 | | 6/1989 |
| EP | 0 384 070 | | 11/1989 |
| EP | 688857 | * | 12/1995 |
| GB | 511836 | | 8/1939 |
| GB | 750747 | | 6/1953 |
| GB | 703091 | | 1/1954 |
| GB | 799721 | | 8/1958 |
| GB | 1 472 408 | | 5/1977 |
| GB | 1 509 154 | | 4/1978 |
| WO | 91/12310 | | 8/1991 |
| WO | 94/12619 | | 6/1994 |
| WO | 94/12620 | | 6/1994 |
| WO | 94/12621 | | 6/1994 |
| WO | 97/11217 | | 3/1997 |
| WO | 97/31090 | | 8/1997 |
| WO | 98/38288 | | 9/1998 |
| WO | 98/59028 | | 12/1998 |
| WO | 99/02632 | | 1/1999 |
| WO | 99/02638 | | 1/1999 |
| WO | 99/02639 | | 1/1999 |
| WO | 99/02641 | | 1/1999 |
| WO | 99/09127 | | 2/1999 |
| WO | 99/23887 | | 5/1999 |
| WO | 99/58632 | | 11/1999 |
| WO | 00/34427 | | 6/2000 |
| WO | 00/60045 | | 10/2000 |

OTHER PUBLICATIONS

Minor et al., *Improved Oxygen Bleacing with dodide and metal Ions* 1973 International Pulp Bleaching Conference Jun. 3–7, 1973 p 83–89.*

* cited by examiner

*Primary Examiner*—Margaret Einsmann
(74) *Attorney, Agent, or Firm*—Milton L. Honig

(57) ABSTRACT

The present invention provides a bleaching composition comprising iodine.

13 Claims, No Drawings

COMPOSITION AND METHOD FOR BLEACHING A SUBSTRATE

FIELD OF INVENTION

This invention relates to compositions and methods for bleaching substrates.

BACKGROUND OF INVENTION

EP-B-311 175 to Unilever discloses a liquid sanitising composition comprising at least 2% by weight of a caustic agent such as sodium hydroxide, from 0 to 1% of a surfactant, at least 3% by weight of an alkali metal hypochlorite and an alkali metal neutral silicate. The compositions disclosed in the EP-B-311 175 are used in industrial machines for bulk ware washing or fabrics washing to ensure an acceptable level of hygiene. The hypochlorite has a tendency to attack the dyes of a fabric and to reduce the integrity of the fabric per se.

Peroxygen bleaches are well known for their ability to remove stains from substrates. Generally, these systems need to be activated. One method of activation is to employ wash temperatures of 60° C. or higher. However, whilst these high temperatures provide a hygiene benefit they often lead to inefficient cleaning, and can also cause premature damage to the substrate.

A preferred approach to generating hydroperoxyl bleach radicals is the use of inorganic peroxides coupled with organic precursor compounds. These systems are employed for many commercial laundry powders. For example, various European systems are based on tetraacetyl ethylenediamine (TAED) as the organic precursor coupled with sodium perborate or sodium percarbonate, whereas in the United States laundry bleach products are typically based on sodium nonanoyloxybenzenesulphonate (SNOBS) as the organic precursor coupled with sodium perborate.

Precursor systems are generally effective but still exhibit several disadvantages. For example, organic precursors are moderately sophisticated molecules requiring multi-step manufacturing processes resulting in high capital costs. Also, precursor systems have large formulation space requirements so that a significant proportion of a laundry powder must be devoted to the bleach components, leaving less room for other active ingredients and complicating the development of concentrated powders. Moreover, precursor systems do not bleach very efficiently in countries where consumers have wash habits entailing low dosage, short wash times, cold temperatures and low wash liquor to substrate ratios.

UK patent 703,091 discloses a germicidal composition comprising a solution of iodine in a water soluble, nonionic surface-active agent having a polyglycol ether group.

UK patent 1,509,154 discloses an iodophore solution comprising a surfactant, which may be readily stirred and pumped with little tendency towards foaming.

SUMMARY OF INVENTION

It is an object of the invention to provide an inexpensive bleaching composition. We have found that iodine may be used at surprisingly low levels such that extinction coefficient of the iodine in the visible does not discolour a white textile. In general, the level of iodine used in bleaching is lower than that conventionally used for hygiene applications.

The present invention provides a bleaching composition comprising: (a) iodine or a source thereof in the range from 0.0005 wt % to 5.0 wt %; and, (b) the balance carriers and adjunct ingredients. Preferably the iodine or source thereof is present in the range from 0.01 wt % to 3.0 wt %, most preferably from 0.02 wt % to 0.5 wt %. It is preferred that the iodine is present in the form of molecular iodine ($I_2$).

The present invention also extends to a method of bleaching a fabric stain, the method comprising the steps of contacting the fabric stain with the bleaching composition. Sun drying and thermal exposure serves to accelerate the bleaching effect. In use it is preferred that a wash liquor comprises a solution of iodine in the range from 3 to 30 ppm.

A preferred format is one in which the bleaching composition comprises a buffering agent and a surfactant. The buffering agent such that a unit dose of the composition in an aqueous medium provides pH in the range from 4 to 9, preferably from 7 to 9.

A unit dose as used herein is a particular amount of the bleaching composition used for a type of wash. The unit dose may be in the form of a defined volume of powder, granules or tablet.

The bleaching composition of the present invention exhibits anti-dye transfer properties. The problem of dye transfer is most acute when a wash is conducted at high temperatures. Dye transfer problems are particularly problematic in Europe where high wash temperatures are found. The present invention also extends to a method of anti-dye transfer.

The present invention may also be used in the form of a pre-wash or post-wash treatment. Suitable treatment means for application to a textile material include sprays, pens, roller-ball devices, bars, soft solid applicator sticks and impregnated cloths or cloths containing microcapsules. Such means are well known in the analogous art of deodorant application and/or in spot treatment of textiles. The bleaching composition may be applied using tapes, sheets or sticking plasters coated or impregnated with the substance, or containing microcapsules of the substance. The bleaching composition may for example be incorporated into a drier sheet so as to be activated or released during a tumble-drier cycle, or the substance can be provided in an impregnated or microcapsule-containing sheet so as to be delivered to the textile when ironed.

The present invention also extends to a commercial package comprising the bleaching composition of the present invention together with instructions for its use.

Iodine

Iodine may be used in a detergent composition specifically suited for stain bleaching purposes, and this constitutes a second aspect of the invention. In this regard, it is preferred that the bleaching composition comprises from 0.5 wt % to 50 wt % of a surfactant, preferably 5 wt % to 20 wt %.

In the preferred granular format, it is preferred that the iodine is coated or cogranulated with a substance that reduces the vapour pressure of the iodine. Suitable coatings and methods of application thereto are described in detail in WO9958632, herein incorporated by reference. It is preferred that the coating comprises one or more compounds selected from the group waxes, parafin oils, fatty acids, esters of fatty acids, fatty alcohols, polyalkoxy fatty alcohols, polyalkoxy fatty acids, esters of polyalkoxy fatty acids, organic polymeric compounds, nonionic surfactants, starches, starch derivatives and inorganic minerals, preferably comprising clays, silicas, silicates and borosilicates.

Another preferred bleaching format is one in which the iodine containing bleaching composition is in the form of a liquid format. Such a format overcomes any problem associated with iodine vapour. In addition, in contrast to a peroxygen bleach, e.g., a perborate or percarbonate, that loses activity in a liquid format the liquid iodine bleach is more stable with respect to shelf-life when a hardened surfactant is present in contrast to an unsaturated surfactant.

It is within the scope of this invention for the iodine to be generated in situ (a source thereof). An example of the in situ generation of iodine is the catalysed decomposition of iodate ($IO_3^-$).

Balance Carriers and Adjunct Ingredients

The bleaching composition preferably comprises other materials such as detergents/surfactants, fillers, builders (e.g., zeolites and/or sodium carbonate), and enzymes. Transition metal sequestrants such as EDTA, and phosphonic acid derivatives such as EDTMP (ethylene diamine tetra (methylene phosphonate)) may also be included, for example to improve the stability sensitive ingredients such as enzymes, fluorescent agents and perfumes, but provided the composition remains bleaching effective. If required other bleach actives may be present such as other peroxygen species and activators. These balance carriers and adjunct ingredients preferably make up the bulk of the bleaching composition to 100% but do not exclude the presence of other minor ingredients. The bleaching composition may also incorporate one or more dyes or perfumes to mask colour and smell ascribable to the iodine in the bleaching composition.

The Detergent Composition

The surfactant used in the present invention has an HLB (hydrophilic/lipophilic balance) greater that 5, more preferably greater than 10, and most preferably greater than 15. For a discussion of HLB the reader is directed to and article by Griffin, W. C. in J. Soc. Cosmetic Chemists Vol. 1 page 311, 1945 and Davies, J. T. and Rideal, E. K. in Interfacial Phenomena, Acad. Press, NY, 1961, pages 371 to 382. The HLB value requirement reflects the importance of the rate of solubility and dispersibility of the surfactant having a degree of hydroperoxide present from the bleaching composition to the aqueous wash medium inconjunction with surface activity towards the substrate being washed.

This surfactant system may in turn comprise 0 to 95% by weight of one or more anionic surfactants and 5 to 100% by weight of one or more nonionic surfactants. The surfactant system may additionally contain amphoteric or zwitterionic detergent compounds, but this in not normally desired owing to their relatively high cost.

In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981.

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are $C_6$–$C_{22}$ alkyl phenol-ethylene oxide condensates, generally 5 to 25 EO, i.e. 5 to 25 units of ethylene oxide per molecule, and the condensation products of aliphatic $C_8$–$C_{18}$ primary or secondary linear or branched alcohols with ethylene oxide, generally 5 to 40 EO.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$–$C_{18}$ alcohols, produced for example from tallow or coconut oil, sodium and potassium alkyl $C_9$–$C_{20}$ benzene sulphonates, particularly sodium linear secondary alkyl $C_{10}$–$C_{15}$ benzene sulphonates; and sodium alkyl glyceryl ether sulphates, especially those ethers of the higher alcohols derived from tallow or coconut oil and synthetic alcohols derived from petroleum. The preferred anionic detergent compounds are sodium $C_{11}$–$C_{15}$ alkyl benzene sulphonates and sodium $C_{12}$–$C_{18}$ alkyl sulphates. Also applicable are surfactants such as those described in EP-A-328 177 (Unilever), which show resistance to salting-out, the alkyl polyglycoside surfactants described in EP-A-070 074, and alkyl monoglycosides.

Preferred surfactant systems are mixtures of anionic with nonionic detergent active materials, in particular the groups and examples of anionic and nonionic surfactants pointed out in EP-A-346 995 (Unilever). Especially preferred is surfactant system that is a mixture of an alkali metal salt of a $C_{16}$–$C_{18}$ primary alcohol sulphate together with a $C_{12}$–$C_{15}$ primary alcohol 3-7 EO ethoxylate.

The nonionic detergent is preferably present in amounts greater than 10%, e.g. 25 to 90% by weight of the surfactant system. Anionic surfactants can be present for example in amounts in the range from about 5% to about 40% by weight of the surfactant system.

The detergent composition may take any suitable physical form, such as a powder, granular composition, tablets, a paste or an anhydrous gel.

Enzymes

The detergent compositions of the present invention may additionally comprise one or more enzymes, which provide cleaning performance, fabric care and/or sanitation benefits.

Said enzymes include oxidoreductases, transferases, hydrolases, lyases, isomerases and ligases. Suitable members of these enzyme classes are described in Enzyme nomenclature 1992: recommendations of the Nomenclature Committee of the International Union of Biochemistry and Molecular Biology on the nomenclature and classification of enzymes, 1992, ISBN 0-12-227165-3, Academic Press.

Examples of the hydrolases are carboxylic ester hydrolase, thiolester hydrolase, phosphoric monoester hydrolase, and phosphoric diester hydrolase which act on the ester bond; glycosidase which acts on O-glycosyl compounds; glycosylase hydrolysing N-glycosyl compounds; thioether hydrolase which acts on the ether bond; and exopeptidases and endopeptidases which act on the peptide bond. Preferable among them are carboxylic ester hydrolase, glycosidase and exo- and endopeptidases. Specific examples of suitable hydrolases include (1) exopeptidases such as aminopeptidase and carboxypeptidase A and B and endopeptidases such as pepsin, pepsin B, chymosin, trypsin, chymotrypsin, elastase, enteropeptidase, cathepsin B, papain, chymopapain, ficain, thrombin, plasmin, renin, subtilisin, aspergillopepsin, collagenase, clostripain, kallikrein, gastricsin, cathepsin D, bromelain, chymotrypsin C, urokinase, cucumisin, oryzin, proteinase K, thermomycolin, thermitase, lactocepin, thermolysin, bacillolysin. Preferred among them is subtilisin; (2) glycosidases such as α-amylase, β-amylase, glucoamylase, isoamylase, cellulase, endo-1,3(4)-β-glucanase (β-glucanase), xylanase, dextranase, polygalacturonase (pectinase), lysozyme, invertase, hyaluronidase, pullulanase, neopullulanase, chitinase, arabinosidase, exocellobiohydrolase, hexosaminidase, mycodextranase, endo-1,4-β-mannanase (hemicellulase), xyloglucanase, endo-β-galactosidase (keratanase), mannanase and other saccharide gum degrading enzymes as described in WO-A-99/09127. Preferred among them are α-amylase and cellulase; (3) carboxylic ester hydrolase including carboxylesterase, lipase, phospholipase, pectinesterase, cholesterol esterase, chlorophyllase, tannase and wax-ester hydrolase. Preferred among them is lipase.

Examples of transferases and ligases are glutathione S-transferase and acid-thiol ligase as described in WO-A-98/59028 and xyloglycan endotransglycosylase as described in WO-A-98/38288.

Examples of lyases are hyaluronate lyase, pectate lyase, chondroitinase, pectin lyase, alginase II. Especially preferred is pectolyase, which is a mixture of pectinase and pectin lyase.

Examples of the oxidoreductases are oxidases such as glucose oxidase, methanol oxidase, bilirubin oxidase, catechol oxidase, laccase, peroxidases such as ligninase and those described in WO-A-97/31090, monooxygenase, dioxygenase such as lipoxygenase and other oxygenases as described in WO-A-99/02632, WO-A-99/02638, WO-A-99/02639 and the cytochrome based enzymatic bleaching systems described in WO-A-99/02641.

The activity of oxidoreductases, in particular the phenol oxidising enzymes in a process for bleaching stains on fabrics and/or dyes in solution and/or antimicrobial treatment can be enhanced by adding certain organic compounds, called enhancers. Examples of enhancers are 2,2'-azo-bis-(3-ethylbenzo-thiazoline-6-sulphonate (ABTS) and Phenothiazine-10-propionate (PTP). More enhancers are described in WO-A-94/12619, WO-A-94/12620, WO-A-94/12621, WO-A-97/11217, WO-A-99/23887. Enhancers are generally added at a level of 0.01% to 5% by weight of detergent composition.

Builders, polymers and other enzymes as optional ingredients may also be present as found in WO0060045.

Suitable detergency builders may also be present as found in WO0034427. These are exemplified in part as found below.

The bleach composition of the present invention may also contains a detergency builder, for example in an amount of from about 5 to 80% by weight, preferably from about 10 to 60% by weight.

Builder materials may be selected from 1) calcium sequestrant materials, 2) precipitating materials, 3) calcium ion-exchange materials and 4) mixtures thereof.

Examples of calcium sequestrant builder materials include alkali metal polyphosphates, such as sodium tripolyphosphate; nitrilotriacetic acid and its water-soluble salts; the alkali metal salts of carboxymethyloxy succinic acid, ethylene diamine tetraacetic acid, oxydisuccinic acid, mellitic acid, benzene polycarboxylic acids, citric acid; and polyacetal carboxylates as disclosed in U.S. Pat. No. 4,144,226 and U.S. Pat. No. 4,146,495.

Examples of precipitating builder materials include sodium orthophosphate and sodium carbonate.

Examples of calcium ion-exchange builder materials include the various types of water-insoluble crystalline or amorphous aluminosilicates, of which zeolites are the best known representatives, e.g. zeolite A, zeolite B (also known as zeolite P), zeolite C, zeolite X, zeolite Y and also the zeolite P-type as described in EP-A-0,384,070.

In particular, the compositions of the invention may contain any one of the organic and inorganic builder materials, though, for environmental reasons, phosphate builders are preferably omitted or only used in very small amounts. Typical builders usable in the present invention are, for example, sodium carbonate, calcite/carbonate, the sodium salt of nitrilotriacetic acid, sodium citrate, carboxymethyloxy malonate, carboxymethyloxy succinate and water-insoluble crystalline or amorphous aluminosilicate builder materials, each of which can be used as the main builder, either alone or in admixture with minor amounts of other builders or polymers as co-builder.

It is preferred that the composition contains not more than 5% by weight of a carbonate builder, expressed as sodium carbonate, more preferably not more than 2.5% by weight to substantially nil, if the composition pH lies in the lower alkaline region of up to 10.

The invention will now be further illustrated by way of the following non-limiting examples:

EXAMPLE 1

Stains were created on white woven cotton by placing three drops of either (a) 0.1% wt. solution of beta-carotene in sunflower oil, or (b) saturated solution of turmeric in sunflower oil.

The stains were washed at 30° C. in 300 ml of water containing 2.1 g of Persil Colour™ washing powder. The wash contained two beta-carotene stained cloths, two turmeric stained cloths and two clean pieces of cotton cloth (white ballast), with a total weight of 5 g. After the wash the cloths were rinsed in an acidic solution, dried in a tumble dryer for 10 minutes and the residual staining relative to clean white cloth measured using a reflectometer and expressed as the ΔE value. The discoloration of the white ballast due to transfer of coloured matter in the wash was measured in an analogous manner.

The experiment was repeated but excess iodine ($I_2$) was added to the wash liquor to give a saturated solution of iodine (Iodine solubility in water at 25° C. is 340 mg/kg). The results are shown in Table 1:

TABLE 1

| Cloth | Control/ΔE(av) | Iodine/ΔE(av) |
|---|---|---|
| Beta-carotene | 26.4 | 28.8 |
| Turmeric | 34.9 | 18.9 |
| White ballast | 2.7 | 0.3 |

From Table 1 it is evident that the use of iodine reduces the staining of the turmeric stain and reduces transfer of colour to the white ballast.

EXAMPLE 2

The experimental was similar to that of Example 1; 150 ml of water at 40° C. was used with 1 g of Persil Colour™ and following the wash and rinse the stains were irradiated in a Weatherometer for 12 minutes. The Weatherometer produces artificial sunlight and simulates line drying. The cloth weighed a total of 6.4 g and had been aged over night. The turmeric stains were created with four drops of the oil.

The results of the wash are given in Table 2 and clearly show stain removal on both stains and a reduction in stain transfer to white cotton.

TABLE 2

| Cloth sample/stain | Control/ΔE(av) | Iodine/ΔE(av) |
|---|---|---|
| Beta-carotene | 16.0 | 6.3 |
| Turmeric | 22.0 | 5.8 |
| White ballast | 4.4 | 2.3 |

A large reduction in colour transfer to the white ballast was observed.

EXAMPLE 3

The experimental was similar to that of Example 1; 150 ml of water at 40° C. was used with 1 g of Persil Colour™ and following the wash and rinse the stains were irradiated in a Weatherometer for 12 minutes. The Weatherometer produces artificial sunlight and simulates line drying. The cloth weighed a total of 6.4 g and had been aged over night. The turmeric stains were created with four drops of the oil.

TABLE 3

| Equivalent weight Iodine on formulation | Iodine (ppm) in solution | ΔE |
|---|---|---|
| 0% | 0 | 8.6 |
| 0.090% | 6 | 7.4 |
| 0.180% | 12 | 5.8 |
| 0.360% | 24 | 2.6 |
| 0.720% | 48 | 2.3 |
| 1.801% | 120 | 1.6 |

For all levels of iodine used the stain transfer was reduced.

EXAMPLE 4

Stains were created on white woven cotton by placing one drop of either (a) 0.1% wt. solution of beta-carotene in sunflower oil or (b) saturated solution of turmeric in sunflower oil.

The stains were washed at 25° C. in 100 ml of water containing 0.5 g of WISK™ washing liquid. The pH of the wash liquor was 8.4. The wash contained two beta-carotene, two turmeric stains and two clean pieces of cotton, with a total weight of 4 g. Following the wash the cloths were rinsed then ironed dry using a convention iron. The residual staining relative to clean white cloth measured using a reflectometer and expressed as the ΔE value. The discoloration of the white ballast due to transfer of coloured matter in the wash was measured and expressed as the % reflectance at 460 nm.

The experiment was repeated but Iodine ($I_2$) was added from a 4.7% ethanol solution, such that there was 17 ppm Iodine in the wash (corresponding to 0.33% on weight formulation). The results are shown in Table 4:

TABLE 4

| Cloth | Control/ΔE(av) | Iodine/ΔE(av) |
|---|---|---|
| Beta-carotene | 12.0 | 3.3 |
| Turmeric | 29.4 | 14.6 |
| | R460 (average) | |
| White ballast | 90.0 | 95.5 |

Following the wash the turmeric and white ballast from the iodine wash were whiter/cleaner than the control. No difference was observed between the beta-carotene stains until the stains were ironed.

EXAMPLE 6

Beta-carotene and turmeric stains were created as per Example 1, except two drops of oil were used per stain. Two of the beta-carotene stains, two of the turmeric stains and two clean white pieces of cotton (total weight 2.8 g) were washed in 100 ml of 25° C. water containing 0.1 g of sodium dodecyl sulfate as a surfactant and buffered to pH=2 using standard salts. After 15 minutes in the wash solution the clothes were removed and thoroughly rinsed in water then wrung. The ΔE of the damp clothes was then measured relative to clean white cotton. Following this the clothes were left to dry for 30 minutes in air then briefly ironed until dry and the ΔE re-measured relative to dry clean white cotton. The experiment was repeated with iodine added to the wash liquor (34 ppm in solution).

The experiment was repeated except the solution was buffered to pH 5, 8 and 11.

The results are shown in the Tables below.

TABLE 5

| | wet results | | | | | |
|---|---|---|---|---|---|---|
| | ΔE(average) | | | | | |
| | White cotton | | Turmeric stain | | Beta-carotene stains | |
| Ph | control | iodine | control | iodine | control | iodine |
| 2 | 4.0 | 0.5 | 54.0 | 42.0 | 38.5 | 18.9 |
| 5 | 2.9 | 0.4 | 55.7 | 18.5 | 42.4 | 19.1 |
| 8 | 4.1 | 0.6 | 48.2 | 16.9 | 43.5 | 10 |
| 11 | 2.8 | 1.1 | 52.6 | 38.8 | 47.9 | 44.8 |

TABLE 6

| | dry results | | | | | |
|---|---|---|---|---|---|---|
| | ΔE(average) | | | | | |
| | White cotton | | Turmeric stain | | Beta-carotene stains | |
| Ph | control | iodine | control | iodine | control | iodine |
| 2 | 3.1 | 0.6 | 42.7 | 34.7 | 26.2 | 11.7 |
| 5 | 2.4 | 0.4 | 43.5 | 20.0 | 28.4 | 10.2 |
| 8 | 2.7 | 0.3 | 37.7 | 14.1 | 28.6 | 5.1 |
| 11 | 2.6 | 0.7 | 41.5 | 28.1 | 29.4 | 31.4 |

From Table 6 it can be seen that the benefits are observed immediately post wash and after drying. The benefits are pH dependent, increasing in the order (i.e. smallest first) pH 11, 2, 5 then 8.

What is claimed is:

1. A method of bleaching a textile, the textile carrying a stain, the method comprising the following steps:

(i) adding a unit dose of a bleaching composition comprising: iodine in the range from 0.0005 wt % to 5 wt % by weight of the composition; and, the balance carriers and adjunct ingredients to an aqueous medium thereby providing an aqueous iodine bleaching environment, the environment being buffered in a pH ranging from 4 to 9;

(ii) contacting the textile with the aqueous iodine bleaching environment;

(iii) rinsing the textile with water; and, (iv) drying the textile.

2. A method according to claim 1, wherein the aqueous iodine bleaching environment comprises iodine at a concentration in the range from 3 to 30 ppm.

3. A method of bleaching a textile according to claim 1, wherein the bleaching composition comprises a builder.

4. A method of bleaching a textile according to claim 1, wherein the bleaching composition comprises a fluorescent agent.

5. A method of bleaching a textile according to claim 1, wherein the bleaching composition comprises an enzyme.

6. A method of bleaching a textile according claim 1, wherein the environment is buffered in the pH range from 7 to 9.

7. A method of bleaching a textile according to claim 1, wherein the bleaching composition is provided in the form of a liquid.

8. A method of bleaching a textile according to claim 1, wherein the bleaching composition is provided in the form of a solid.

9. A method of bleaching a textile according to claim 1, wherein the iodine has been coated end/or cogranulated with a substance that reduces the vapour pressure of iodine.

10. A method of bleaching a textile according to claim 1, wherein the bleaching composition comprises a surfactant in the range from 0.5 wt % to 50 wt %.

11. A method of bleaching a textile according to claim 10, wherein the bleaching composition comprises a surfactant in the range from 5 wt % to 20 wt %.

12. A method of bleaching a textile according to claim 1, wherein the stain is selected from the group consisting of beta-carotene and turmeric.

13. A method of bleaching a textile according to claim 1, wherein the bleaching environment is buffered in the pH range from about 5 to about 8.

* * * * *